US010782017B2

(12) United States Patent
Gort et al.

(10) Patent No.: US 10,782,017 B2
(45) Date of Patent: Sep. 22, 2020

(54) WING VANED FLAME SHAPER

(71) Applicant: TRANE INTERNATIONAL INC., Davidson, NC (US)

(72) Inventors: Thomas Gort, Tyler, TX (US); Stephen Stewart Hancock, Flint, TX (US); Wayne N. Kraft, Tyler, TX (US)

(73) Assignee: TRANE INTERNATIONAL INC., Davidson, NC (US)

( * ) Notice: Subject to any disclaimer, the term of this patent is extended or adjusted under 35 U.S.C. 154(b) by 13 days.

(21) Appl. No.: 15/961,490

(22) Filed: Apr. 24, 2018

(65) Prior Publication Data

US 2019/0323708 A1 Oct. 24, 2019

(51) Int. Cl.
*F23D 14/24* (2006.01)
*F23D 14/62* (2006.01)
*F23D 14/58* (2006.01)

(52) U.S. Cl.
CPC ..... *F23D 14/24* (2013.01); *F23D 14/58* (2013.01); *F23D 14/62* (2013.01)

(58) Field of Classification Search
CPC ..... F23D 14/24; F23D 14/58; F23D 14/62
USPC ..... 431/182–183, 9; 126/109, 116 R
See application file for complete search history.

(56) References Cited

U.S. PATENT DOCUMENTS 790,714 A 5/1905 Bray
2,121,948 A 6/1938 Borland
3,018,823 A 1/1962 Alger
3,196,927 A 7/1965 Alger
3,251,393 A 5/1966 Beach et al.
3,706,446 A * 12/1972 Briggs ..... F24H 3/04 432/224
4,052,141 A 10/1977 Dudheker et al.
5,083,917 A 1/1992 McCullough et al.
5,460,514 A * 10/1995 Toyoshima ..... F23D 11/40 431/183
5,735,687 A 4/1998 Knopfel et al.
5,992,410 A 11/1999 Raleigh et al.
6,331,109 B1 12/2001 Paikert et al.
7,204,688 B2 4/2007 Han
7,566,218 B2 7/2009 Aldrich
7,632,091 B2 12/2009 Steinbach et al.
8,708,696 B2 4/2014 Ghoniem et al.
8,919,337 B2 12/2014 Schultz et al.

FOREIGN PATENT DOCUMENTS

EP 0672864 9/1995

* cited by examiner

*Primary Examiner* — Vivek K Shirsat
(74) *Attorney, Agent, or Firm* — Hamre, Schumann, Mueller & Larson, P.C.

(57) ABSTRACT

This disclosure relates to flame shapers for use in gas burners, gas burner systems, and methods for operating gas burner systems. Flame shaper embodiments include an opening having an unobstructed center, and turning vanes that extend from the perimeter of the opening towards its center. The turning vanes are configured to induce swirling in an ignited flame. Burner systems include an ignition source, the flame shaper, and a heat exchanger. In method embodiments, a flame is formed by igniting fuel and air, the flame is directed through the flame shaper, and the flame is then directed into a heat exchanger.

19 Claims, 7 Drawing Sheets

WING VANED FLAME SHAPER

FIELD

This disclosure relates generally to flame shapers located downstream of ignition in burners, for example burners in furnace systems, and furnace systems including such flame shapers downstream of ignition.

BACKGROUND

Burners used for heating in gas furnaces typically discharge a flame into a heat exchanger. Depending on the shape of the flame and the flows of the combusting gases, the flame may impinge on the tube of the heat exchanger. This impingement creates a hot spot at the point of contact, which reduces both heat exchanger efficiency and lifetime. Burners may use venturi tubes to control the shape and size of the flame. In some gas burners, swirlers may be used prior to ignition to direct the flow of air and/or fuel prior to combustion.

BRIEF SUMMARY

This disclosure relates generally to flame shapers located downstream of ignition in burners, for example burners in furnace systems, and furnace systems including such flame shapers downstream of ignition. More particularly, this disclosure relates to flame shapers and furnace systems including flame shapers that include a plurality of turning vanes, configured to induce a swirl in an ignited flame passing through the flame shaper.

Flame shapers according to this disclosure result in improved heat transfer, reduced emissions, reduced noise, low-pressure drop of flow through the combustion system, and improved mixing between fuel-rich and fuel-lean regions of a flame. Flame shaper embodiments herein may improve mixing to reduce impingement and improve heat transfer. Flame shaper embodiments may reduce emissions by improving mixing of fuel and air and thus also produce more efficient combustion. Flame shapers according to this disclosure may reduce noise by producing fuel-air mixing with less turbulence and less aggressive mixing. Flame shapers according to this disclosure may provide lower pressure drop by allowing more flow through the flame shaper compared to other designs and reducing the turbulence when mixing the fuel and air.

In an embodiment, a gas furnace burner system includes an ignition source and a flame shaper located downstream of the ignition source. The ignition source is configured to ignite a fuel-air mixture to produce a flame. The flame shaper includes an opening and plurality of turning vanes extending from the opening, the turning vanes configured to induce a swirl in the flame.

In an embodiment, a heat exchanger tube is downstream of the flame shaper with respect to the direction of flow. In an embodiment, the opening of the flame shaper has a diameter that is at or about 50% to at or about 90% of a diameter of the heat exchanger tube.

In an embodiment, the flame shaper has a central portion which does not obstruct the flame. In an embodiment, the gas furnace burner system further includes a flame holder, and a diameter of the central portion is equal to a diameter of the flame holder.

In an embodiment, each of the turning vanes have an axial twist and a radial twist over their length.

In an embodiment, the fuel-air mixture is a partial premix of fuel and air. In an embodiment, a gas furnace is operated by a method including providing a fuel-air mixture including fuel, igniting the fuel-air mixture using an ignition source to produce a flame, directing an airflow and the flame through a flame shaper inducing a swirl in the flame to form a swirl-mixed flame and directing the swirl-mixed flame into a heat exchanger. In an embodiment, the flame shaper includes a plurality of turning vanes.

In an embodiment, the fuel-air mixture is a partial premix of fuel and air.

In an embodiment, the flame shaper has a center of an opening that is unobstructed. In an embodiment, the opening of the flame shaper is has a diameter that is between at or about 50% and at or about 90% of a diameter of a tube of the heat exchanger.

DETAILED DESCRIPTION

This disclosure relates generally to flame shapers located downstream of ignition in burners, for example burners in furnace systems, and furnace systems including such flame shapers downstream of ignition. More particularly, this disclosure relates to flame shapers and furnace systems including flame shapers that include a plurality of turning vanes, configured to induce a swirl in a flame that is ignited and then passes through the flame shaper.

Figure 1:
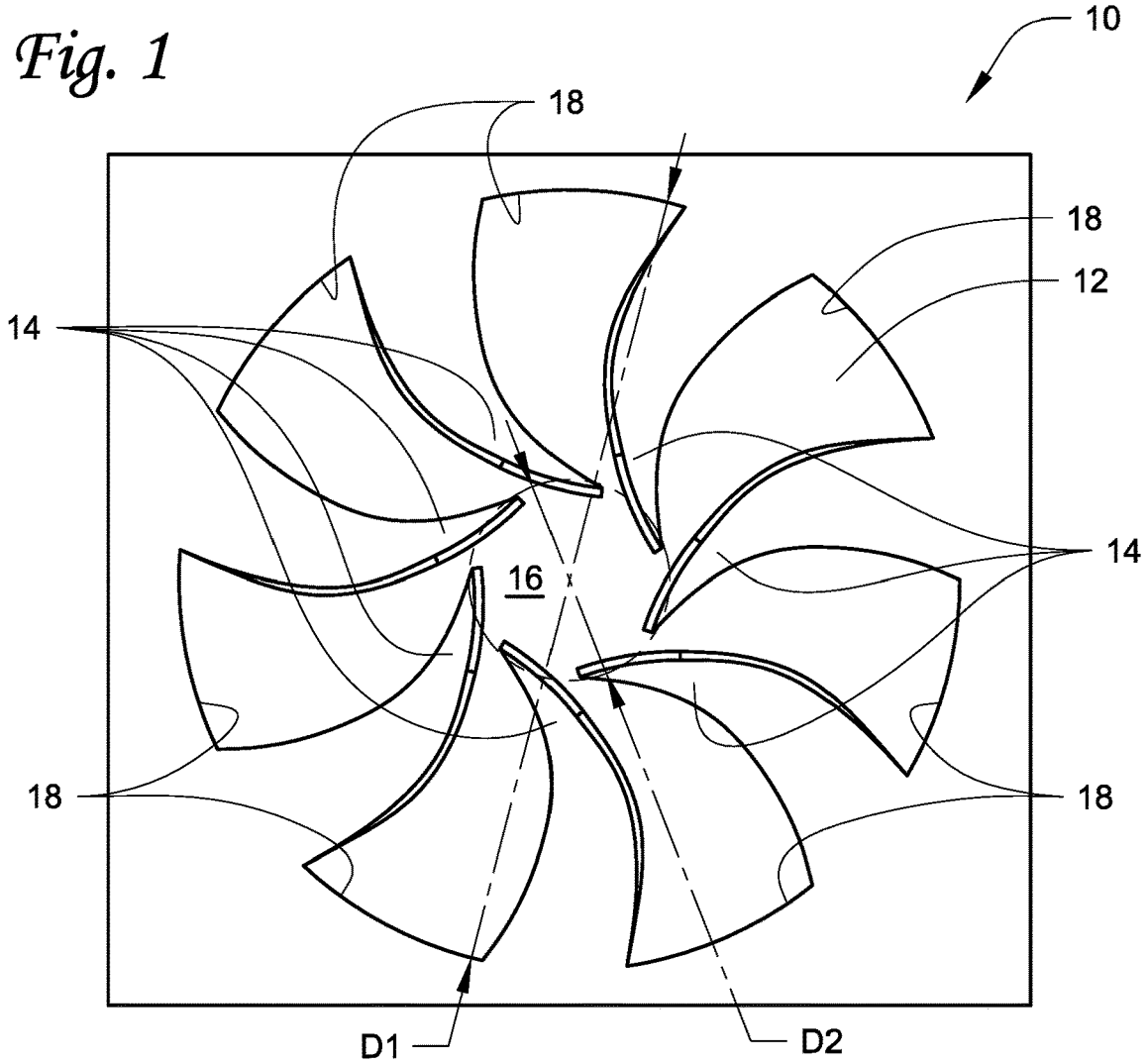
FIG. 1 shows an embodiment of a flame shaper for a burner in a gas furnace.

FIG. 1 shows an embodiment of a flame shaper for a burner in a gas furnace. Flame shaper 10 includes an opening 12 through which the flame is directed, with a plurality of turning vanes 14 distributed around the edge of opening 12 and projecting towards a center portion 16 of the flame shaper 10. The center portion 16 of opening 12 in flame shaper 10 is not obstructed by any of the plurality of turning vanes 12.

Flame shaper 10 is a device located downstream of an ignition source (shown as 46 in FIG. 4) that ignites a fuel-air mixture that includes fuel and air to produce a flame. The fuel may be, for example, natural gas. The ignited flame is directed through flame shaper 10 prior to entering a heat exchanger (not shown) where the flame exchanges heat with a fluid, for example air, to be directed into a space by a furnace system. The fuel-air mixture and ignited flame have a direction of flow from a fuel source, to the ignition source, and through the flame shaper 10 towards the interior of the heat exchanger. In an embodiment, flame shaper 10 is formed by cutting and twisting a metal sheet. In an embodiment, flame shaper 10 is formed through casting. Flame shaper 10 is not limited to a method of manufacture and may be manufactured by any suitable process or technique or materials to obtain the flame shaper structure suitable herein.

Flame shaper 10 is configured to induce a swirl in the flame as it passes through flame shaper 10. Flame shaper 10 is made of materials capable of maintaining their shape when exposed to the heat produced by the flame of the main burner, for example between 1000 and 1400° F. The materials include, but are not limited to for example, ceramics or steel such as aluminized or stainless steel and the like. Flame shaper 10 promotes mixing of the core flow of fuel and air with additional air to control the combustion reaction, controlling the shape and length of the flame and promoting efficient combustion to reduce emissions and waste. Flame shaper 10 controls the flow of fuel and air out of the burner and into the heat exchanger, and therefore influences the pressures within the burner and, for example, the pumping requirements for fuel used in the gas furnace.

Opening 12 is an opening in flame shaper 10 through which the flame passes. Opening 12 is defined by an outer perimeter 18 and has a substantially unobstructed center portion 16 having diameter D2. The size of opening 12 may be based on the size of the heat exchanger receiving flame from flame shaper 10. For example, the diameter D1 of opening 12 may be in the range of at or about 50% to at or about 90% of the diameter of the heat exchanger tubes. In an embodiment, the diameter of opening 12 is at or about 80% of the diameter of the tube of the heat exchanger receiving flame from flame shaper 10. A plurality of turning vanes 14 extend from the outer perimeter 18 into the opening 12.

A plurality of turning vanes 14 are distributed around the perimeter 18 of opening 12. Each of the plurality of turning vanes 14 is at least in part angled with respect to the direction of flow. The plurality of turning vanes 14 are configured to induce swirling in a flame passing through flame shaper 10. In an embodiment, each of the plurality of turning vanes 14 are shaped such that they are twisted in both the radial and axial directions. Twisting in the radial direction is a twist in the turning vane 14 with respect to a center of the opening 12. Twisting in the axial direction is a twist in a length direction from a leading edge to a trailing edge of the turning vane with respect to the direction of flow. The shape of turning vane 14 may be a wing shape. In an embodiment, the turning vanes 14 of the flame shaper 10 become closer to parallel with the direction of flow as they extend from the outer perimeter 18 into opening 12. In an embodiment, the turning vanes 14 may be substantially perpendicular to the direction of the flame at the outer perimeter 18 of opening 12. Flame shaper 10 may include, for example, five to nine turning vanes 14. In an embodiment, the plurality of turning vanes 14 includes seven turning vanes.

Figure 4:
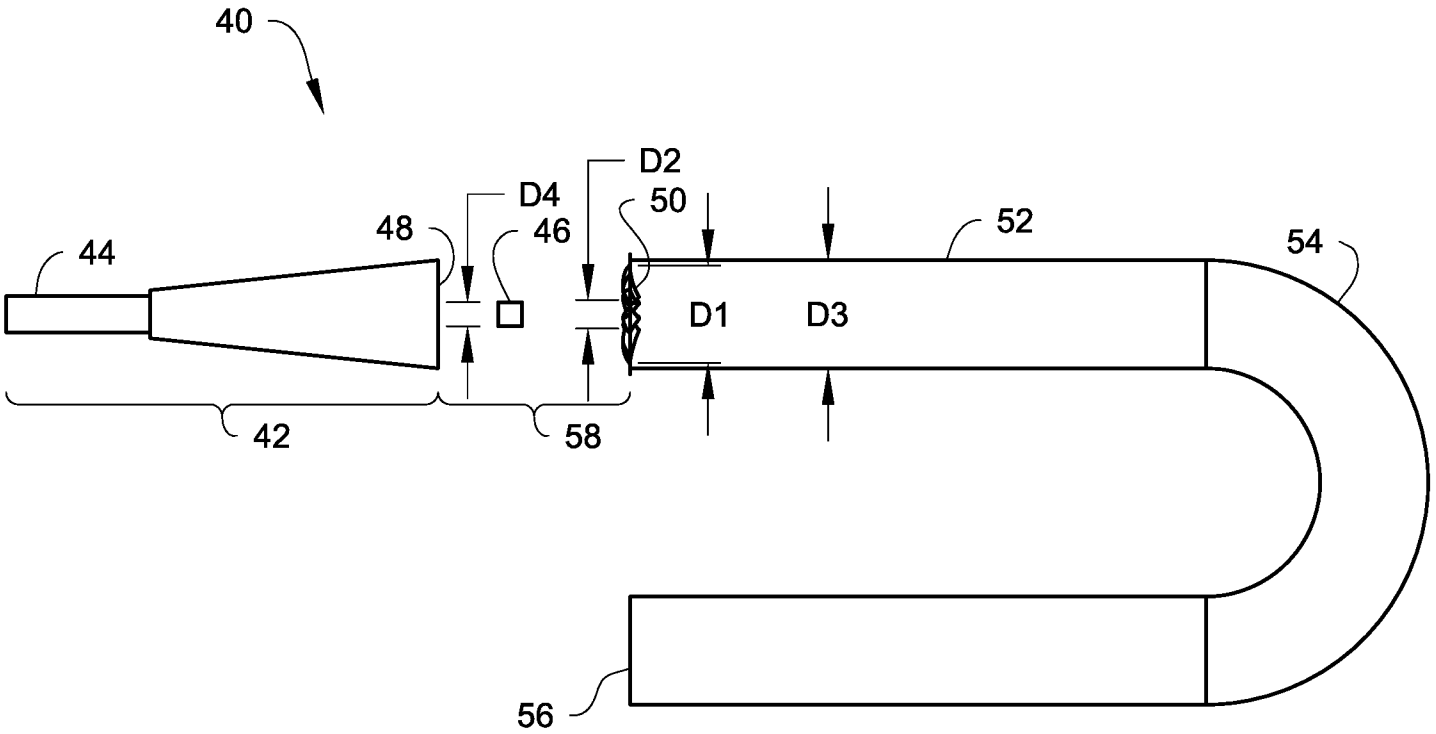
FIG. 4 shows an embodiment of a gas furnace burner and heat exchanger system including a flame shaper.

Center portion 16 of opening 12 in flame shaper 10 is an open area configured to allow an ignited fuel-rich core flow to pass through. Center portion 16 is not substantially obstructed by features of flame shaper 10, including the plurality of turning vanes 14. In an embodiment, the tips of each of the plurality of turning vanes may be located in center portion 16. In an embodiment, the tips of each of the plurality of turning vanes have a major axis parallel to the direction of flow of the fuel-rich core flow passing through center portion 16. In an embodiment, center portion 16 is completely unobstructed, with no elements in the path of the flame through center portion 16. Center portion 16 may have a diameter D2 approximately equal to a diameter of a flame holder on a burner face of a burner providing flame to flame shaper 10. The burner face and flame holder are shown in FIG. 4 and described in more detail below. In an embodiment, the diameter of a flame holder may be defined by the distance between the outermost openings on the burner face.

Figure 2:
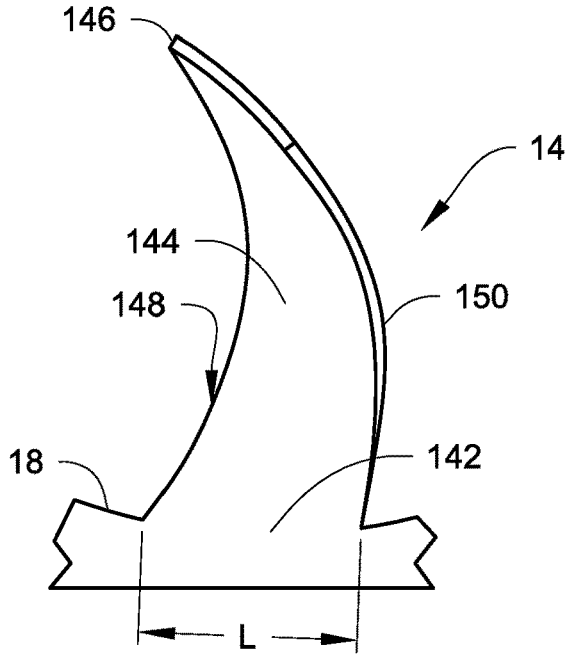
FIG. 2 shows a turning vane of an embodiment.

FIG. 2 shows one of the plurality of turning vanes 14 included in the embodiment shown in FIG. 1. In an embodiment, each of the plurality of turning vanes 14 has the same shape. In an embodiment, the shape of turning vane 14 may be a wing shape. Turning vane 14 has a base 142 at which it meets the perimeter 18 of the opening 12 of flame shaper 10, a twisting portion 144 extending from the base 142, and tip 146 at the end of twisting portion 142. Twisting portion 144 has a leading edge 148 and a trailing edge 150. Turning vane 14 has a length L from the leading edge 148 to the trailing edge 150. In an embodiment, the length L of turning vane 14 is less at or near the tip 146 than at the base 142. In an embodiment, length L of the turning vane 14 decreases gradually from the base 142 towards the tip 146. In an embodiment, leading edge 148 forms an undercurve and trailing edge 150 forms an overcurve as turning vane 14 twists as it extends from base 142 towards tip 146.

Base 142 is where turning vane 14 meets the perimeter 18 of the opening 12 of flame shaper 10. In an embodiment, base 142 is integral with flame shaper 10. In an embodiment, turning vane 14 is joined to flame shaper 10 at base 142. In an embodiment, turning vane 14 may is substantially perpendicular to a direction of flow through flame shaper 10 at base 142.

Twisting portion 144 is the portion of turning vane 14 extending into opening 12 of the flame shaper from base 142. In twisting portion 144, the turning vane may have a twist in the radial direction and a twist in the axial direction. Twisting in the radial direction is a twist in the turning vane 14 with respect to a center of the opening 12. In an embodiment, the twist in the radial direction is a continuous twist over the length of turning vane 14 from base 142 to tip 146 that turns tip 146 away from the center portion 16 of opening 12 of the flame shaper 10. Twisting in the axial direction is a twist in a major axis of the cross-section of the turning vane with respect to the direction of flow. In an embodiment, the twist in the axial direction may be a continuous twist from the major axis of the cross-section of the turning vane 14 being substantially perpendicular to the direction of flow at base 142 to the major axis of the cross-section of the turning vane 14 being substantially parallel to the direction of flow at tip 146.

Tip 146 is the end of the turning vane 14 that is opposite base 142. In an embodiment, the major axis of the cross-section of turning vane 14 is substantially parallel to the direction of flow at tip 146. In an embodiment, tip 146 is outside of the center portion 16 of opening 12 of flame shaper 10.

Leading edge 148 is an edge of turning vane 14. In an embodiment, trailing edge 148 may be closer to the source of the flame passing through flame shaper 10 than the base 142 over at least a portion of twisting portion 144. In an embodiment, leading edge 148 is a first point of contact between a flame and flame shaper 10.

Trailing edge 150 is the edge of turning vane 14 opposite leading edge 148. In an embodiment, leading edge 148 is further away from the source of the flame passing through flame shaper 10 than base 142 over at least a portion of twisting portion 144. In an embodiment, trailing edge 150 is a final point of contact between a flame and flame shaper 10.

Figure 3A:
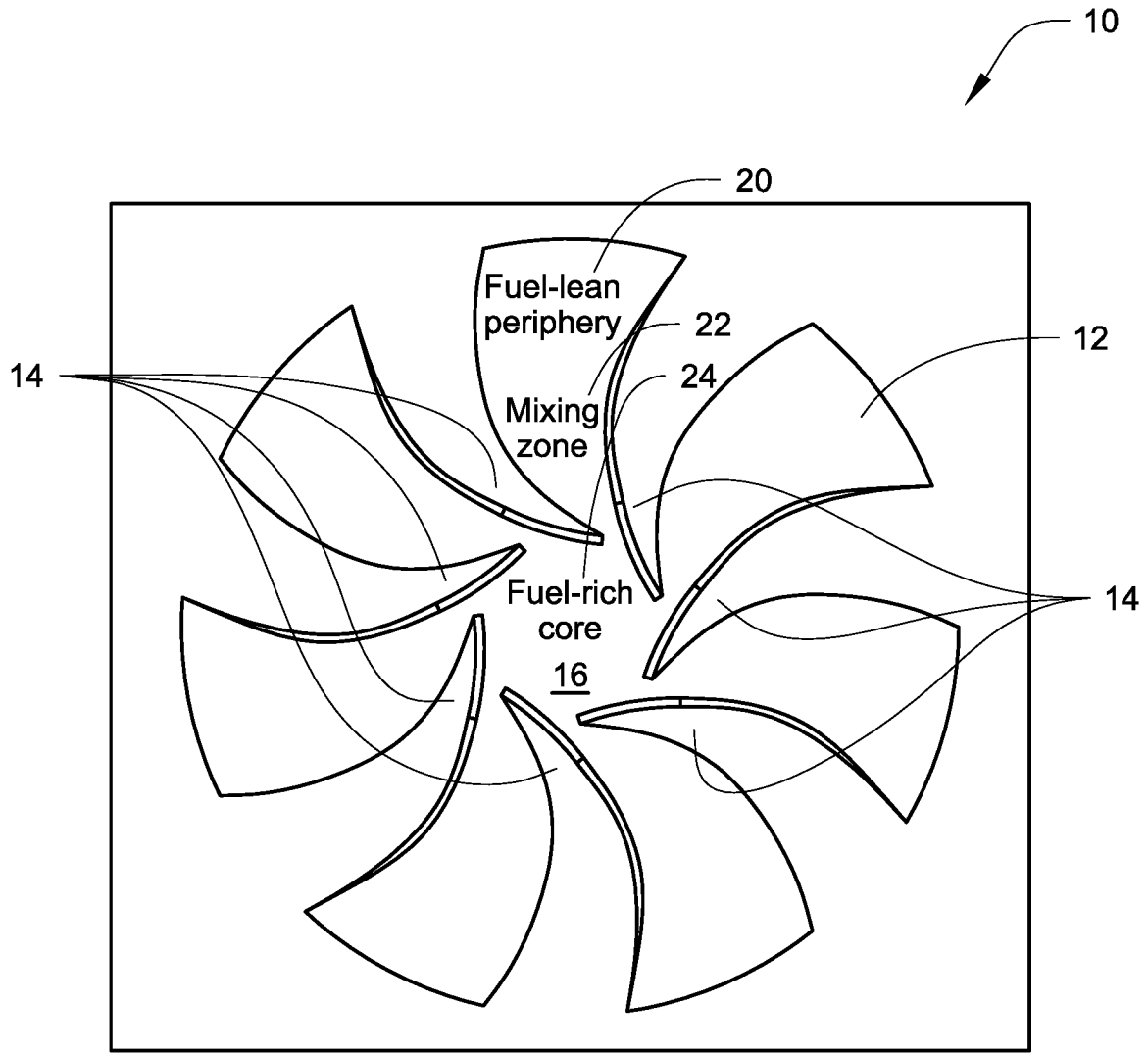
FIG. 3A shows an embodiment of the flame shaper relative to portions of the flame directed through the flame shaper.

FIG. 3A shows the embodiment of the flame shaper of FIG. 1 relative to portions of the flame directed through the flame shaper 10. At the outermost edges of opening 12 is the fuel-lean periphery 20, which is primarily air, drawn in through air intakes of the burner. In mixing zone 22, there is mixing of air and fuel. At the center is fuel-rich core 24, which primarily passes through the substantially unobstructed center portion 16 of the flame shaper 10. A portion of the fuel-rich core 24 may travel through a portion of flame shaper 10 where tips of the plurality of turning vanes 14 are in the path of the fuel-rich core. The terms fuel-lean and fuel-rich are relative terms that describe the relative proportions of fuel versus air in the zones relative to one another. The variance in relative concentrations of fuel and air may vary continuously with radial distance from the center of flame shaper 10. The fuel-rich core 24, fuel-lean periphery 20, and mixing zone 22 are defined by the relative quantities of fuel and air passing through that region of flame shaper 10. Fuel-rich core 24 is where a flow primarily including fuel passes through flame shaper 10. Fuel-lean periphery 20 is where a flow primarily including air passes through flame shaper 10. Mixing zone 22 is where a flow which includes a mixture of fuel and air is mixed by swirling induced as the fuel and air pass through flame shaper 10. In an embodiment, the sources of fuel and air are positioned such that the flow at the core is fuel-lean and the flow at the periphery is fuel-rich.

Figure 3B:
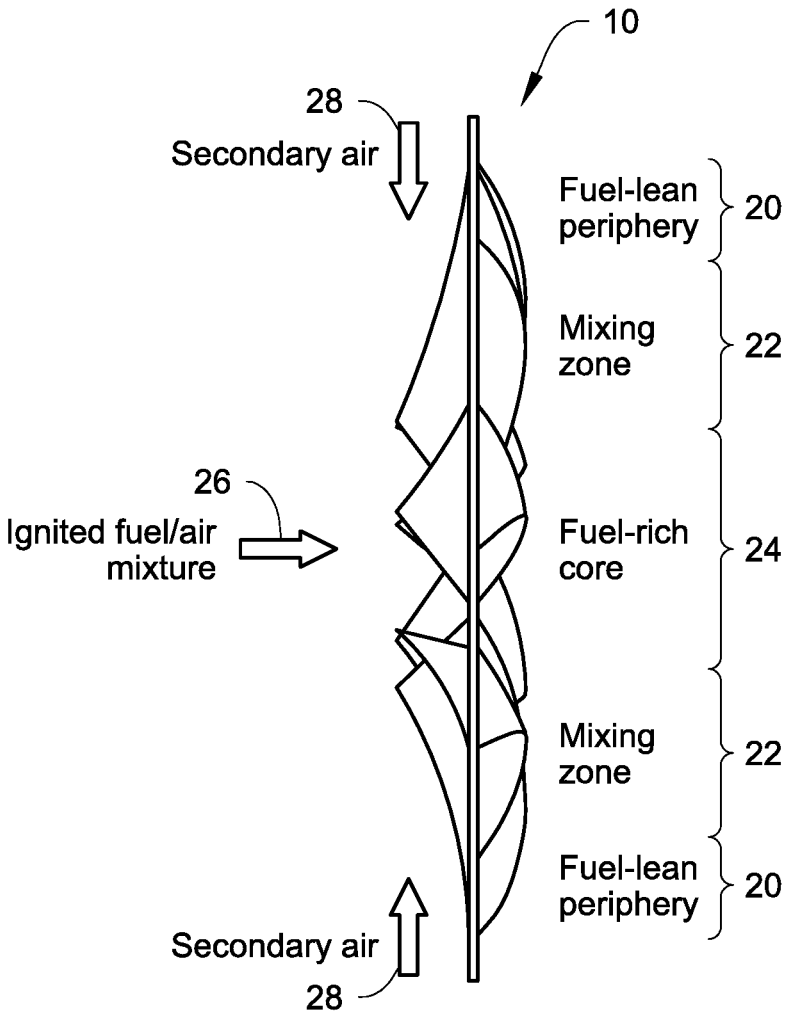
FIG. 3B shows a side view of an embodiment of the flame shaper relative to portions of the flame directed through the flame shaper.

FIG. 3B shows another view of an embodiment of the flame shaper of FIG. 1 relative to portions of the flame directed through the flame shaper. As shown in FIG. 3A, flow through the flame shaper includes a fuel-lean periphery 20, a mixing zone 22, and a fuel-rich core 24. Ignited fuel and air 26 are directed from an ignition source (not shown) towards the flame shaper 10. A secondary flow of air 28 enters the burner (not shown) including flame shaper 10 and passes through the flame shaper 10, which induces mixing of the secondary flow of air 28 with the ignited fuel and air 26.

Ignited fuel and air 26 is a flame including fuel and air that are undergoing a combustion reaction following ignition by an ignition source. Ignited fuel and air is a flame that is directed through the flame shaper 10. Ignited fuel and air 26 is directed towards and through the flame shaper 10. Ignited fuel and air 26 may be a partial premix of fuel and air that is ignited by an ignition source. A partial premix may be a mix of air and fuel having enough oxygen to begin combustion but lacking sufficient oxygen to fully react the fuel. Ignited fuel and air 26 may be ignited by an ignition source (not shown) to begin combustion of the fuel and air, and then directed through flame shaper 10. Ignited fuel and air 26 is the primary component of fuel-rich core 24, and a portion of what is mixed in mixing zone 22 is from the ignited fuel and air 26.

Secondary flow of air 28 is a flow of air into a burner including the flame shaper. Secondary flow of air 28 provides additional oxygen for the combustion reaction. Secondary flow of air may be introduced, for example, by an air intake, for example one or more ports located upstream of the flame shaper 10 with respect to the flow of the ignited fuel and air 26. At the outer perimeter 18 of the opening 12 of the flame shaper 10, the secondary flow of air 28 may travel perpendicular to the direction of flow of the ignited fuel and air 26. The secondary flow of air 28 may be the primary component of fuel-lean periphery 20, and a portion of what is mixed in mixing zone 22.

FIG. 4 shows an embodiment of a burner and heat exchanger system 40. Burner and heat exchanger system 40 includes burner 42, flame shaper 50, and heat exchanger 52. Burner 42 includes a fuel source 44, ignition 46, and burner face 48. Flame leaving burner 42 passes through flame shaper 50 and enters heat exchanger 52.

Fuel source 44 provides fuel that is combusted to provide the heat distributed by gas furnace system 44. Fuel source 44 may be, for example, an inlet connected to a manifold or a gas valve of a gas furnace. In an embodiment, fuel source 44 provides a partial premix of air as well as fuel. In an embodiment, partial premixing of air and fuel occurs after fuel has been provided to the burner by fuel source 44. Fuel from fuel source 44 travels through burner 42 in a direction of flow from fuel source 44 to burner face 48, where it exits burner face 48 through one or more openings. The fuel and air leaving through the openings of burner face 48 of burner 42 passes over ignition 46, is ignited by ignition 46 to produce a flame, and the flame travel towards flame shaper 50.

Ignition 46 initiates combustion of fuel from fuel source 44. Ignition 46 may be, for example, a spark or a hot surface ignition, a pilot light, or other suitable ignition sources. Examples of hot surface ignitions include, for example, silicon carbide or silicon nitride hot surface ignitions. Ignition 46 is upstream of flame shaper 50 with respect to the direction of flow, and the flame from the combustion of the fuel and air mixture initiated by ignition 46 then travels through the flame shaper 50. Ignition 46 may be located in a gap 58 between a burner face 48 and flame shaper 50.

The fuel or a fuel-air premix provided by fuel source 44 and any additional primary air taken into burner 42 exits burner 42 at burner face 48. Burner face 48 includes one or more openings through which the fuel-air mixture exits burner 42. The one or more openings may include one or more flame holders, which are openings capable of supporting a flame. The flame holders may be the outermost openings on burner face 48. The diameter from a flame holder to an opposite flame holder on burner face 48 may define diameter D4. Diameter D2 of a center portion of flame shaper 50 may be about the same size as diameter D4 from flame holder to opposite flame holder on burner face 48. The flow exiting burner face 48 then passes over ignition 46. A gap 58 exists between burner face 48 and flame shaper 50. In an embodiment, air in or entering through gap 58 provides additional oxygen to the fuel-air mixture exiting burner face 48 and being ignited by ignition 46. Air from gap 58 may form the primary component of a fuel-lean periphery of flow through flame shaper 50, such as fuel-lean periphery 20 shown in FIG. 3A and FIG. 3B. Air from gap 58 may be secondary flow of air 28 shown in FIG. 3B.

Flame shaper 50 is a flame shaper configured to promote mixing of the combusting fuel-air mixture of the flame with secondary air. In an embodiment, flame shaper 50 induces a swirl in the combusting fuel-air mixture and secondary air. In an embodiment, flame shaper 50 is the flame shaper 10 as shown in FIG. 1. The flame, after passing through flame shaper 50, enters heat exchanger 52. Flame shaper 50 has an opening having a diameter D1. D1 may be between 50% and 90% of the diameter D3 of a tube of heat exchanger 52. The opening of flame shaper 50 has a center portion having a diameter D2. D2 may approximately equal a diameter D4 measured from flame holder to flame holder on the openings in burner face 48.

Heat exchanger 52 allows for the exchange of heat between the flame leaving flame shaper 50 and air moving through a furnace including the burner and heat exchanger system 40. The tube may be, for example, U-shaped, with a turn 54. In an embodiment, the flame may contact a surface of the heat exchanger at the turn. In heat exchanger 52, the heat given off by the flame is transferred to an airflow, the airflow used to heat a structure such as a dwelling. Heat exchanger 52 has an outlet 56 at an end opposite the end receiving the flame from flame shaper 50.

Figure 5A:
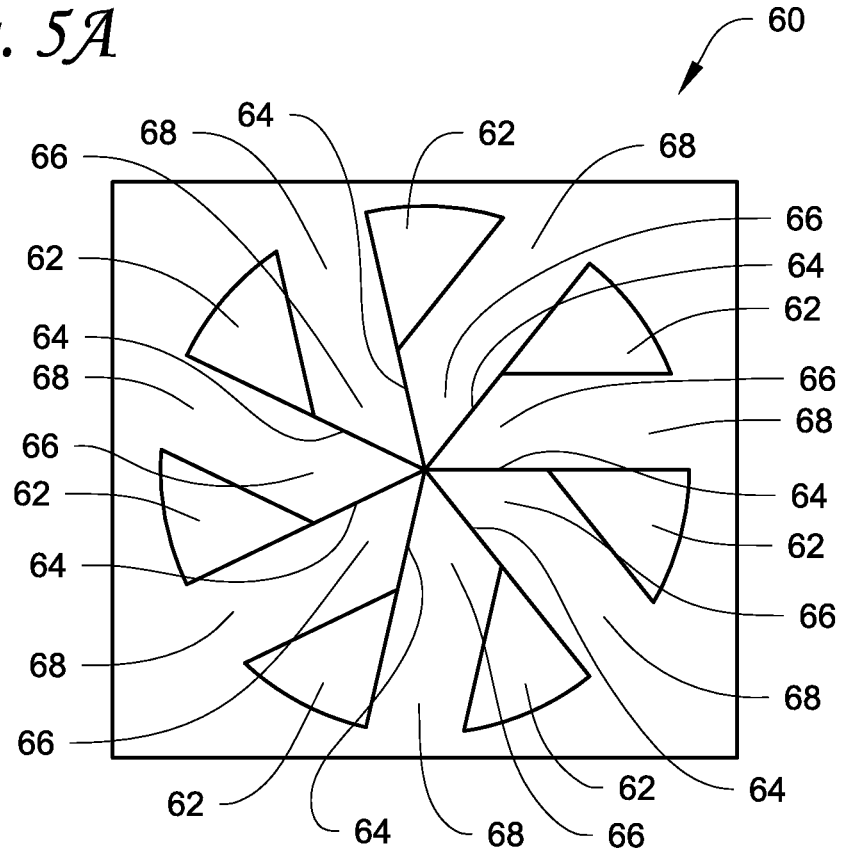
FIG. 5A shows an embodiment of a flat sheet of metal prepared for formation into a flame shaper embodiment by a series of cuts.
Figure 5B:
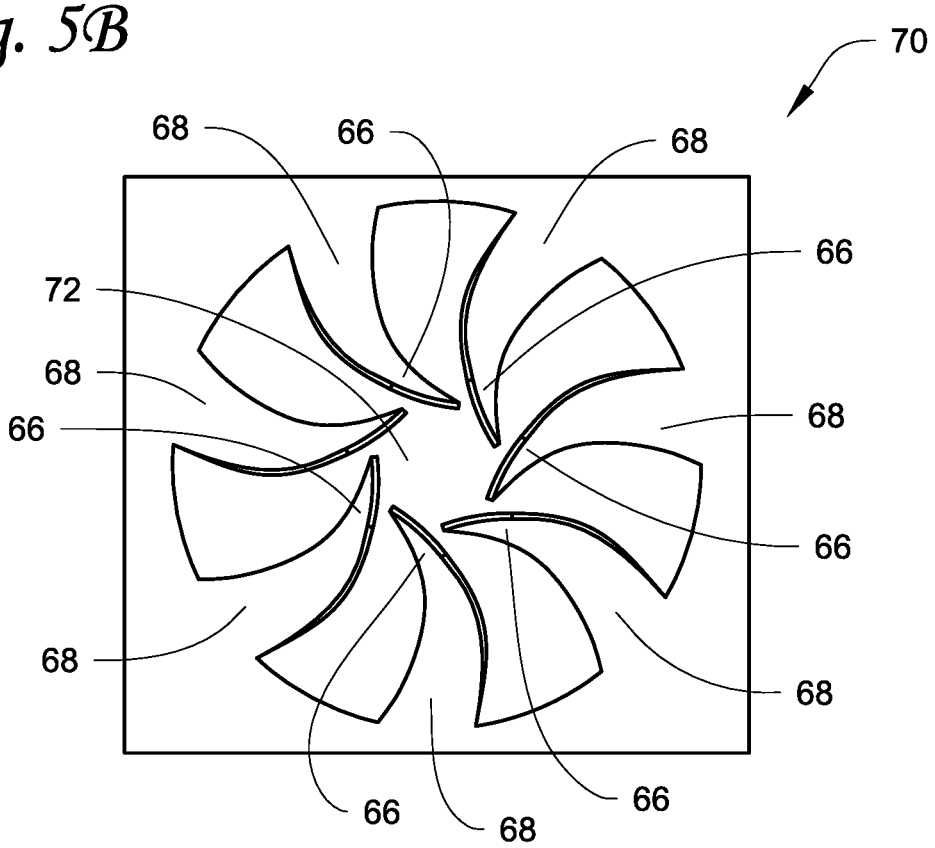
FIG. 5B shows a flame shaper embodiment prepared by performing twisting operations on a sheet of metal cut according to FIG. 5A.

FIG. 5A shows an embodiment of a flat sheet of metal prepared for formation into a flame shaper embodiment by a series of cuts. FIG. 5B shows a flame shaper embodiment prepared by performing twisting operations to a sheet of metal cut according to FIG. 5A.

FIG. 5A shows the cuts made to a flat sheet of material in an embodiment. Flat sheet 60 of material such as steel is cut to create open portions 62 defining the perimeter of an opening of the flame shaper 70. Cuts 64 are made to separate the ends 66 of turning vanes 68 from one another at the center of the opening of the flame shaper.

Flat sheet of material 60 is the material from which flame shaper 70 is manufactured. Flat sheet of material 60 is a sheet of ductile, heat resistant material such as steel Flat sheet of material 60 is cut and twisted to produce a flame shaper 70. Flame shaper 70 may be an embodiment such as flame shaper 10 shown in FIG. 1.

Open portions 62 define the opening of and turning vanes 68 of a flame shaper 70. Open portions 62 include an arc portion forming the perimeter of the opening. Open portions may be created by making a plurality of cuts in the flat sheet of material 60. In an embodiment, the open portions 62 may be formed by making cuts and also bending portions of the flat sheet of material 60 such that the bent portions do not substantially affect the flame, instead of fully removing the material corresponding to the open portion 62. In an embodiment, the open portions may be formed by, for example, making the arc cut defining the perimeter of the opening and making one cut separating the open portion from a leading or trailing edge of one of turning vanes 68, while the material corresponding to the open portion remains connected to the other of a leading or trailing edge of another one of turning vanes 68.

FIG. 5B shows a flame shaper 70 formed by twisting portions of the cut metal sheet of FIG. 5A to shape the turning vanes. Ends 66 of each of turning vanes 68 are twisted such that they do not obstruct the center 72 of an opening in the flame shaper 70. The twisting of material is such that the turning vanes twist from being substantially perpendicular to the direction of flow at the perimeter of the opening to being at an acute angle or parallel to the direction of flow at the ends 66 of each of the turning vanes 68 closest to the opening. Each of turning vanes 68 may have a wing shape following twisting of material.

In an embodiment where a cut is not made to fully separate the open portions 62 from the turning vanes, the material still present in open portions 62 may be twisted into a position to reduce the effect of the material on the shape of a flame, for example by twisting the material such that it is parallel to the direction of flow.

Figure 6:
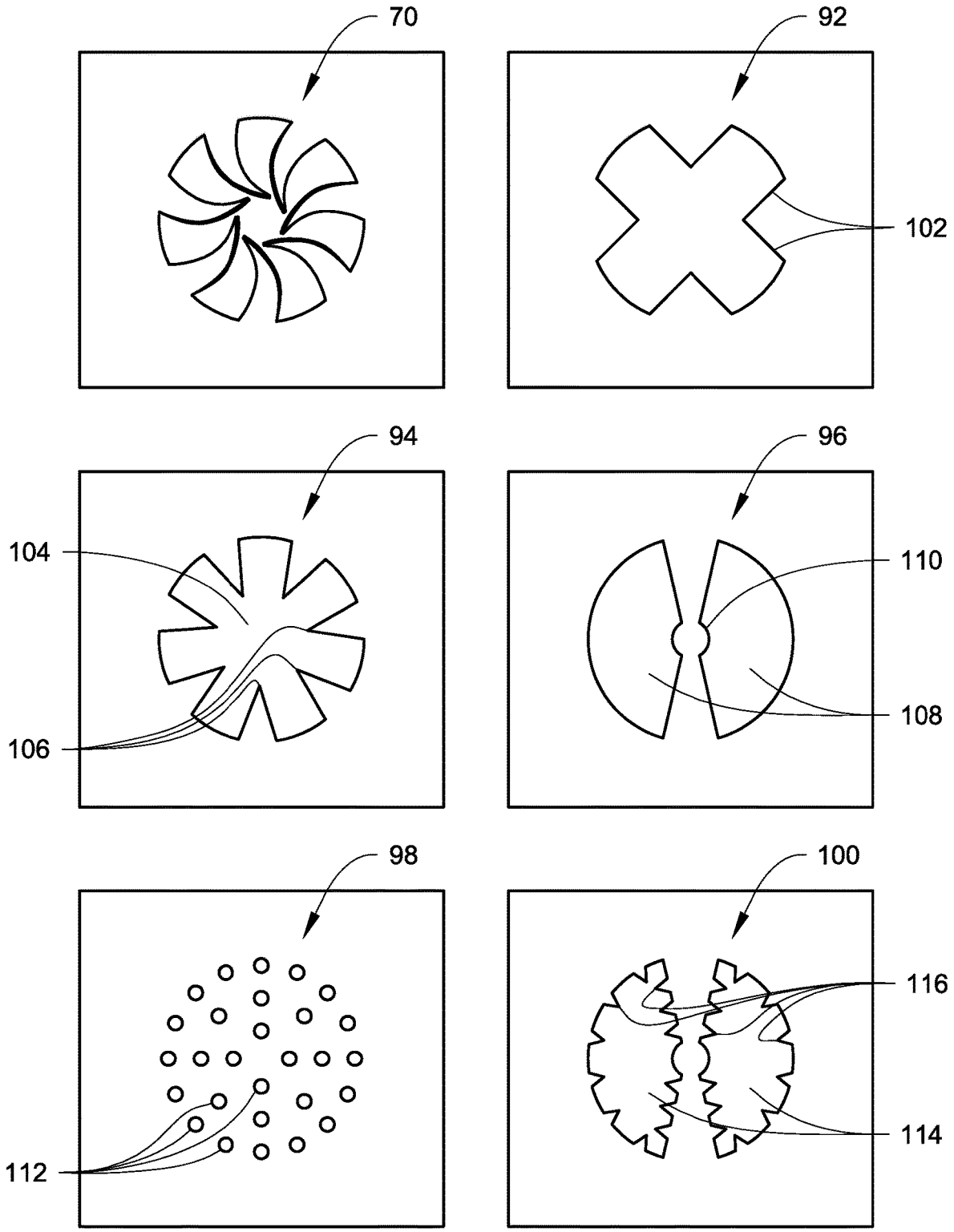
FIG. 6 shows alternative embodiments for flame shapers.

FIG. 6 shows alternative embodiments of flame shapers. Flame shaper 70 is the embodiment shown in FIG. 5. FIG. 6 shows a crossed-slot flame shaper embodiment 92, a toothed opening flame shaper embodiment 94, a cut plate flame shaper embodiment 96, a drilled hole flame shaper embodiment 98, and a toothed cut plate flame shaper embodiment 100. The embodiments shown in FIG. 6 may be located to shape an ignited flame from a burner before it enters a heat exchanger of a furnace.

Crossed-slot flame shaper embodiment 92 includes two overlapping slots 102 that allow a flame to pass through the crossed-slot flame shaper embodiment 92. In an embodiment, the slots 102 are perpendicular to one another. In an embodiment, the slots overlap in a central portion which is unobstructed.

Toothed opening flame shaper embodiment 94 includes a circular opening 104 into which a plurality of teeth 106 project. In an embodiment, the plurality of teeth 106 are triangular in shape, with a point towards the center of opening 104. Each of the teeth 106 are flat, and have a plane perpendicular to the direction of flow through the toothed opening flame shaper embodiment 94. In an embodiment, the toothed opening flame shaper includes seven teeth.

Cut plate flame shaper embodiment 96 includes two semi-circular openings 108. In an embodiment, the two semi-circular openings 108 are configured to allow a flame to pass through the cut plate flame shaper embodiment 96. Between the semi-circular holes 108 are ribs and central portion 110, which obstructs flow through a portion cut plate flame shaper embodiment 96, including a center of the cut plate flame shaper embodiment 96.

Drilled hole flame shaper embodiment 98 includes a plurality of drilled holes 112 that allow a flame to pass through the drilled hole flame shaper embodiment 98. In an embodiment, the plurality of drilled holes may be formed into an array having a pattern within a circular shape. The drilled hole flame shaper embodiment 98 may aggressively promote turbulent mixing of fuel and air in flame passing through the flame shaper. In an embodiment, the drilled holes 112 are each approximately 0.075 inches in diameter Toothed cut plate flame shaper embodiment 100 includes two openings 114 similar to openings 108 and the central portion 110 of the cut plate flame shaper embodiment 96. In an embodiment, the toothed cut plate flame shaper 100 further includes a plurality of teeth 116 extending into the openings 112. The plurality of teeth 116 are triangular in shape, with a point towards the center of opening 104. Each of the teeth 116 are flat, and have a plane perpendicular to the direction of flow through the toothed cut plate flame shaper embodiment 100.

Figure 7:
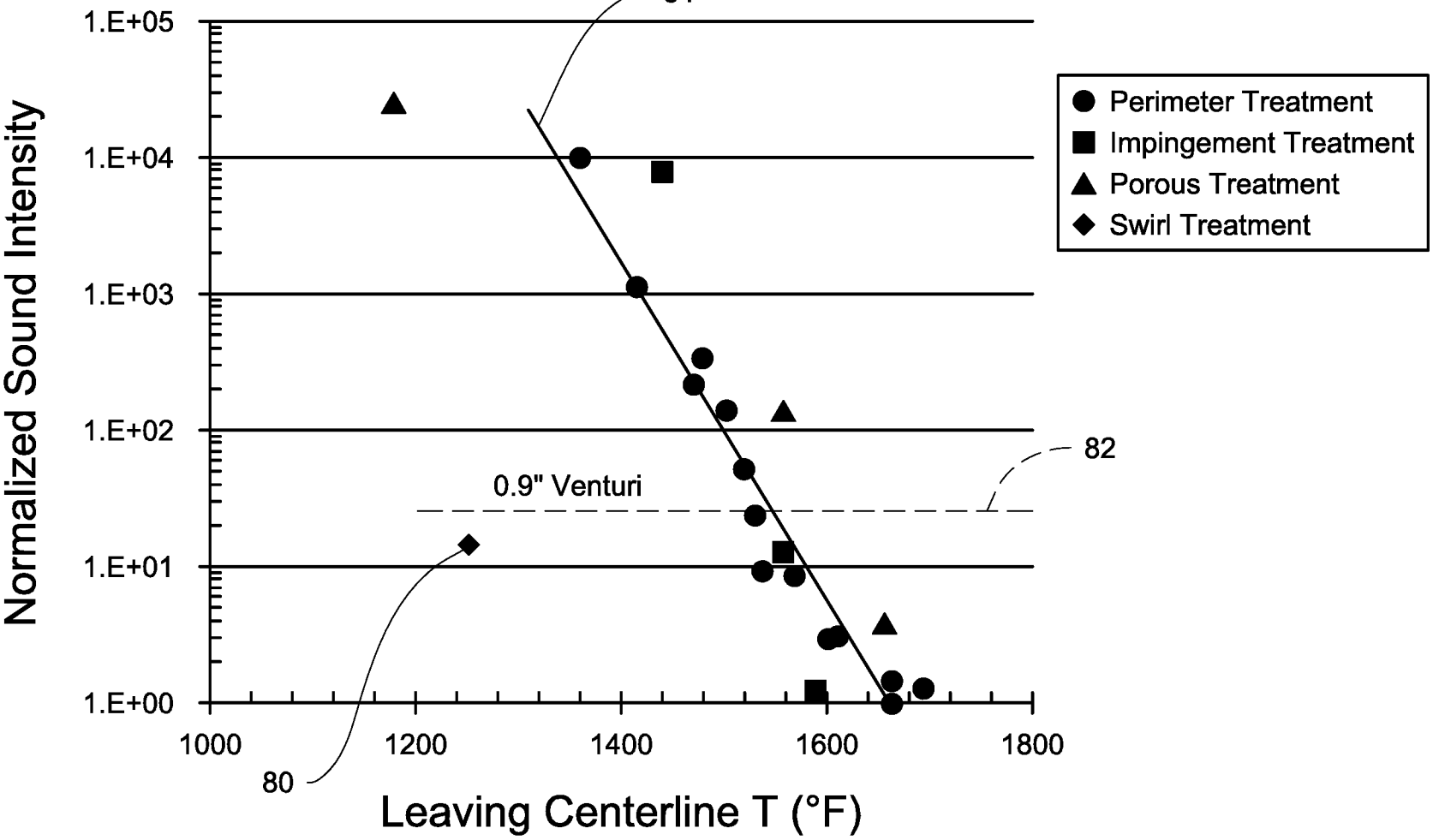
FIG. 7 shows a chart of measurements of normalized sound intensity versus the leaving centerline temperatures at the heat exchanger in various burner and heat exchanger configurations including flame shapers.

FIG. 7 shows a chart of measurements of normalized sound intensity versus the leaving centerline temperatures at the heat exchanger in various burner and heat exchanger configurations including flame shapers. A normalized sound intensity, based on the amplitude of sound waves, normalized to the amplitude of sound waves produced by a burner operated without a flame shaper, is measured for various temperatures at which burners are operated with the tested flame shapers. As shown in the chart of FIG. 7, most flame shaper designs produce significantly more noise when the burner and heat exchanger are operated at a cooler leaving centerline temperature (e.g. the temperature at a point in the center of the flame at a distance downstream of the flame shaper). However, a swirl flame shaper including turning vanes and configured to induce swirl in a combusting fuel-air mixture, such as flame shaper 10 or flame shaper 50, produces a normalized sound intensity result 80 that is less than the noise level of a standard burner flame, in this case the flame of a 0.9 inch venturi at standard temperatures 82, even when the flame shaper according to an embodiment is operated at significantly lower leaving centerline temperatures. The normalized sound intensity result 80 of the swirl flame shaper breaks from the trend line 84 produced by other flame shaper designs as they are operated at different leaving centerline temperatures. Flame shaper embodiments are thus shown to provide significantly lower leaving centerline temperatures, indicating more efficient combustion, without the significant additional noise caused by other flame shaper designs which produce more aggressive and turbulent mixing of fuel and air.

ASPECTS

It is understood that any of aspects 1-8 may be combined with any of aspects 9-13.

Aspect 1

A gas furnace burner system, comprising:

an ignition source, configured to ignite a fuel-air mixture to produce a flame;

a flame shaper, located downstream of the ignition source with respect to a direction of flow of the flame, wherein the flame shaper comprises:

an opening; and a plurality of turning vanes extending from a perimeter of the opening, wherein the plurality of turning vanes are configured to induce a swirl in the flame.

Aspect 2

The gas furnace burner system according to aspect 1, further comprising a heat exchanger tube located downstream of the flame shaper with respect to the direction of flow, wherein the heat exchanger tube receives the flame after the flame passes through the flame shaper.

Aspect 3

The gas furnace burner system according to aspect 2, wherein the opening has a diameter that is between at or about 50% and at or about 90% of a diameter of the heat exchanger tube

Aspect 4

The gas furnace burner system according to any of aspects 1-3, wherein the flame shaper has a central portion wherein the flame is unobstructed in the central portion of the flame shaper.

Aspect 5

The gas furnace burner system according to aspect 4, further comprising a flame holder and wherein a diameter of the central portion is equal to a diameter of the flame holder.

Aspect 6

The gas furnace burner system according to any of aspects 1-5, wherein each of the plurality of turning vanes have an axial twist and a radial twist over the length of the turning vane.

Aspect 7

The gas furnace burner system according to any of aspects 1-6, wherein the fuel-air mixture is partially premixed fuel and air.

Aspect 8

The gas furnace burner system according to any of aspects 6-7, wherein the air intake comprises a plurality of ports.

Aspect 9

A method of operating a gas furnace, comprising:

providing a fuel-air mixture comprising a fuel;

igniting the fuel-air mixture using an ignition source to produce a flame;

directing an airflow and the flame through a flame shaper, the flame shaper inducing a swirl in the airflow and the flame to form a swirl mixed flame; and directing the swirl mixed flame into a heat exchanger of the gas furnace, wherein the flame shaper comprises a plurality of turning vanes.

Aspect 10

The method according to aspect 9, wherein the airflow is provided by an air intake located between the ignition source and the flame shaper with respect to the direction of travel of the flame.

Aspect 11

The method according to any of aspects 9-10, wherein the fuel-air mixture is a partial premix of air and the fuel.

Aspect 12

The method according to any of aspects 9-11, wherein the flame shaper further comprises a center of an opening, wherein the center of the opening is unobstructed.

Aspect 13

The method according to aspect 12, wherein the opening of the flame shaper has a diameter that is between at or about 50% and at or about 90% of a diameter of a tube of the heat exchanger.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A gas furnace burner system, comprising:

an ignition source, configured to ignite a fuel-air mixture to produce a flame;

a flame shaper, located downstream of the ignition source with respect to the direction of flow of the flame, wherein the flame shaper comprises:

an opening;

a plurality of turning vanes extending from a perimeter of the opening, wherein the plurality of turning vanes are configured to induce a swirl in the flame, wherein each of the plurality of turning vanes are substantially perpendicular to the direction of flow of the flame at the perimeter of the opening and substantially parallel to the direction of flow of the flame at a tip of the turning vane.

2. The gas furnace burner system of claim 1, further comprising a heat exchanger tube located downstream of the flame shaper with respect to the direction of flow, wherein the heat exchanger tube receives the flame after the flame passes through the flame shaper.

3. The gas furnace burner system of claim 2, wherein the opening has a diameter that is between at or about 50% and at or about 90% of a diameter of the heat exchanger tube.

4. The gas furnace burner system of claim 1, wherein the flame shaper has a central portion wherein the flame is unobstructed in the central portion of the flame shaper.

5. The gas furnace burner system of claim 4, further comprising a flame holder and wherein a diameter of the central portion is equal to a diameter of the flame holder.

6. The gas furnace burner system of claim 1, wherein each of the plurality of turning vanes have an axial twist and a radial twist over a length of the turning vane.

7. The gas furnace burner system of claim 1, wherein the fuel-air mixture is partially premixed fuel and air.

8. A method of operating a gas furnace, comprising:

providing a fuel-air mixture;

igniting the fuel-air mixture using an ignition source to produce a flame;

directing an airflow and the flame through a flame shaper, the flame shaper inducing a swirl in the airflow and the flame to form a swirl mixed flame; and directing the swirl mixed flame into a heat exchanger of the gas furnace, wherein the flame shaper comprises a plurality of turning vanes, and each of the plurality of turning vanes are substantially perpendicular to the direction of flow of the flame at the perimeter of the opening and substantially parallel to the direction of flow of the flame at a tip of the turning vane.

9. The method of claim 8, wherein the airflow is provided between the ignition source and the flame shaper with respect to the direction of travel of the flame.

10. The method of claim 8, wherein the fuel-air mixture is a partial premix of air and the fuel.

11. The method of claim 8, wherein the flame shaper further comprises a center of an opening, wherein the center of the opening is unobstructed.

12. The method of claim 11, wherein the opening of the flame shaper has a diameter that is between at or about 50% and at or about 90% of a diameter of a tube of the heat exchanger.

13. The gas furnace burner system of claim 6, wherein the axial twist and the radial twist are continuous over the length of the turning vane.

14. The method of claim 8, wherein each of the plurality of turning vanes have an axial twist and a radial twist over a length of the turning vane.

15. The method of claim 14, wherein the axial twist and the radial twist are continuous over the length of the turning vane.

16. A gas furnace burner system, comprising:

an ignition source, configured to ignite a fuel-air mixture to produce a flame;

a flame shaper, located downstream of the ignition source with respect to the direction of flow of the flame, wherein the flame shaper comprises:

an opening;

a plurality of turning vanes extending from a perimeter of the opening towards a center of the opening, wherein the plurality of turning vanes are configured to induce a swirl in the flame, wherein each of the plurality of turning vanes have an axial twist and a radial twist over a length of the turning vane and the axial twist and the radial twist are continuous over the length of the turning vane.

17. The gas furnace burner system of claim 16, further comprising a heat exchanger tube located downstream of the flame shaper with respect to the direction of flow, wherein the heat exchanger tube receives the flame after the flame passes through the flame shaper.

18. The gas furnace burner system of claim 17, wherein the opening has a diameter that is between at or about 50% and at or about 90% of a diameter of the heat exchanger tube.

19. The gas furnace burner system of claim 16, wherein the flame shaper has a central portion wherein the flame is unobstructed in the central portion of the flame shaper.

* * * * *